US009489825B1

(12) United States Patent
McDonnell et al.

(10) Patent No.: US 9,489,825 B1
(45) Date of Patent: Nov. 8, 2016

(54) COMPUTERIZED SCHOOL SAFETY SYSTEM

(71) Applicants: James F. McDonnell, Alexandria, VA (US); Bradley A. Clark, Round Hill, VA (US); Briana T. McClain, Alexandria, VA (US)

(72) Inventors: James F. McDonnell, Alexandria, VA (US); Bradley A. Clark, Round Hill, VA (US); Briana T. McClain, Alexandria, VA (US)

( * ) Notice: Subject to any disclaimer, the term of this patent is extended or adjusted under 35 U.S.C. 154(b) by 0 days.

(21) Appl. No.: 14/708,929

(22) Filed: May 11, 2015

(51) Int. Cl.
*G08B 26/00* (2006.01)
*G08B 27/00* (2006.01)
*G08B 25/01* (2006.01)

(52) U.S. Cl.
CPC ..... *G08B 27/001* (2013.01); *G08B 25/016* (2013.01)

(58) Field of Classification Search
CPC ..... G08B 27/001; G08B 25/016
USPC ..... 340/539.13, 286.07, 541, 539.11; 455/404.1, 404.2, 456.3, 521
See application file for complete search history.

(56) References Cited

U.S. PATENT DOCUMENTS

| | | | | |
|---|---|---|---|---|
| 7,983,654 | B2 | 7/2011 | Shelton et al. | |
| 8,532,609 | B2 | 9/2013 | Spector | |
| 8,768,294 | B2 | 7/2014 | Reitnour et al. | |
| 8,838,064 | B2 | 9/2014 | Taylor et al. | |
| 8,890,685 | B1 * | 11/2014 | Sookman | H04W 4/22 340/539.13 |
| 2014/0025724 | A1 * | 1/2014 | Granger | G08B 21/0297 709/203 |
| 2014/0077947 | A1 | 3/2014 | Lee | |
| 2014/0378090 | A1 * | 12/2014 | Hall | A63F 13/10 455/404.2 |
| 2015/0065081 | A1 | 3/2015 | Estes et al. | |
| 2015/0199896 | A1 * | 7/2015 | Estes | G08B 27/001 340/541 |
| 2016/0057596 | A1 * | 2/2016 | Thompson | H04W 4/22 455/404.1 |

FOREIGN PATENT DOCUMENTS

WO WO 2015034904 A1 3/2015

* cited by examiner

*Primary Examiner* — Dhaval Patel
(74) *Attorney, Agent, or Firm* — Vincent Re PLLC

(57) ABSTRACT

A computerized school safety system is disclosed for providing information to an emergency responder about an alert at a school. The system includes a computerized processor including programming configured to monitor inputs from a mobile computerized device within the school, the inputs including location data for the mobile computerized device, combine the inputs with a floor plan for the school, and provide a tactical display to the emergency responder comprising the combined inputs and floor plan.

19 Claims, 11 Drawing Sheets

COMPUTERIZED SCHOOL SAFETY SYSTEM

FIELD OF THE DISCLOSURE

The present disclosure relates generally to a computerized system to manage information during an emergency in a school. In particular, the disclosure provides a computerized system to acquire status updates from teachers and staff members in the school during an emergency and provide the information for a coordinated tactical response to emergency responders.

BACKGROUND

The statements in this section merely provide background information related to the present disclosure. Accordingly, such statements are not intended to constitute an admission of prior art.

Schools drill for emergency situations. Students are taught how to behave during a fire drill in case the school needs to be evacuated for a fire event. School staff are taught how to respond to medical emergencies. Schools develop lock-down procedures in the event that an active shooter or a threatening individual comes into the school.

Cellular devices, mobile phones, smart phones, tablet computers, and similar devices are known and widely distributed. Many such devices include touch-screen displays that permit one to both view information and provide feedback input to one small screen. Digital communication through these devices has trained much of the public to immediately take out their mobile computerized device whenever one desires to communicate.

Mobile computerized devices typically include locating systems or a locating device within the mobile device. In one exemplary embodiment, cellular devices in communication with cellular towers can quickly and accurately determine a current location for the phone based upon triangulated signals from the cellular towers. In another embodiment, global positioning satellites provide information to electronic devices, enabling the device to determine a location based upon the satellite signals. In another embodiment, proximity sensors and/or functionality provided by a Bluetooth® connection can be used to determine a location of a computerized device.

SUMMARY

A computerized school safety system is disclosed for providing information to an emergency responder about an alert at a school. The system includes a computerized processor including programming configured to monitor inputs from a mobile computerized device within the school, the inputs including location data for the mobile computerized device, combine the inputs with a floor plan for the school, and provide a tactical display to the emergency responder comprising the combined inputs and floor plan.

BRIEF DESCRIPTION OF THE DRAWINGS

One or more embodiments will now be described, by way of example, with reference to the accompanying drawings, in which.

DETAILED DESCRIPTION

Figure 2:
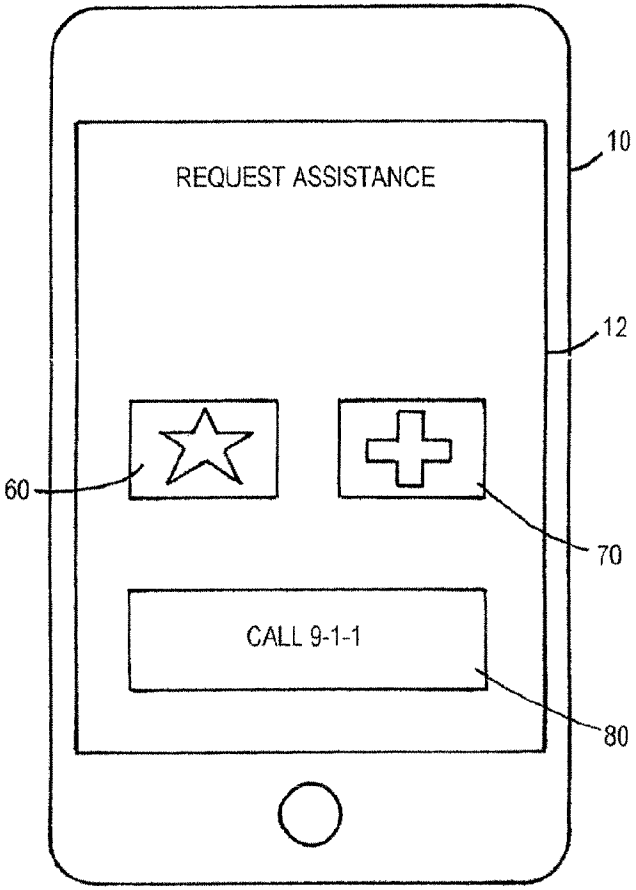
FIG. 2 illustrates an exemplary smart phone displaying buttons for a teacher to select requested help during a fire alert, in accordance with the present disclosure.

Non-limiting and non-exhaustive embodiments of the present disclosure are described with reference to the following figures, wherein like reference numerals refer to like parts throughout the various views unless otherwise specified.

A computerized system for providing a flow of information in a school environment is disclosed. Portable computerized devices such as smart phones are widely used and carried by adults. Teachers, staff, and administrators of schools can utilize software to provide easy access to status information regarding anything going on at the school through portable computerized devices. According to the disclosed system, a simple set of digitized buttons can be presented on a touch screen of a computerized device, and an exemplary teacher can provide an instant update for the students currently being tended to by the teacher. Such buttons can be placed upon the screen at the prompting of the teacher. For example, if a student needs medical attention or if two students get in a first fight, the teacher can activate the disclosed system and press an appropriate button which will activate the system, alert the principal and any other appropriate personnel such as the school nurse, and provide immediate location data for the teacher activating the system.

The disclosed system can be operated in a number of ways. The system can operated solely based upon a teacher activating a mobile device and sending out a signal without any prompts to the teachers' phone from a server or a central computer, for example, preserving the teacher's privacy until a medical emergency requires the teacher to activate the system to receive immediate assistance. In another embodiment, the system can be centralized, with a principal or a system coordinator activating an alert or a status inquiry, with a centralized computer or server sending out a command to mobile devices registered with the system, prompting or commanding the mobile devices to request information from the teacher directly and/or to gather information from the mobile device such as a location. In another embodiment, a hybrid system can be operated to include, for example, only activating when prompted by a teacher when operating in normal mode, but, for example, based upon previously provided permission of the teacher, the system activating a remote inquiry to the teacher's device upon activation of an alert such as a fire drill or an active shooter alert.

Privacy can be a serious concern when providing a location service through mobile devices. The disclosed system can be provided with different privacy settings or configurations based upon the privacy concerns. For example, a non-invasive mode or configuration can be operated where the system interacts with the device of the teacher only when the teacher prompts the system for assistance. In another example, the system can accept a request from the principal for the teacher or teachers to provide a current location, the request can be displayed upon the teacher's device, and the teacher can give permission or deny permission for the phone to provide a location to the system. In another example, the teacher can be provided with an ability enable or disable different levels of privacy settings, for example, permitting the system to monitor a location of the phone only when the teacher is on school grounds or only between certain hours of the day. In another example, the system can be enabled to actively monitor locations of the teachers only after the prompting of an emergency alarm, such as a fire alarm. In another example, the system can be enabled to monitor locations of the teachers only if two people, such as the principal and the school counselor, both provide permission for the system to do so for a time period. In another example, the system can be enabled by the principal to monitor the locations of the teachers based upon the principal's discretion with an active display on the screen of the mobile devices warning the teachers that the principal has activated the location service. A number of different privacy settings for the disclosed system are envisioned, and the disclosure is not intended to be limited to the particular examples provided herein.

The status buttons on a teacher's computerized device can alternatively be activated remotely, for example, by the school principal activating a fire alert or activating a active shooter alert. The principal can, upon a computerized device, select from a number of presented alerts to create automatic reactions in the system and provide status inquiries to all relevant persons in the school. For example, in a fire drill or an actual fire evacuation, the principal can activate the alert from a desktop computer. Alarms in the school through an audio system can be activated automatically. Buttons can be presented to an exemplary teacher enabling the teacher to select an appropriate response. For example, four buttons can be presented to a teacher during a fire drill, the buttons prompting status updates from the teacher including 1) "We're OK," 2) "Danger Nearby," 3) "Send Help," and 4) "Out of Room."

An emergency responder screen can be operated during emergencies or drills. Such an emergency responder screen can be the same or similar information that is provided to a system coordinator such as a principal. However, additional information can be provided, such as a tactical display of the school including interactive options for the responders. For example, responders get an exemplary color coded image of the floor plan for the school, and location data and status information for each of the classes can be provided. A graphic indicating where the fire alarm was activated or where smoke has been spotted can be displayed. A responder can tap a particular teacher's icon and be connected by cellular communications with the teacher. One team of responders can annotate the floor plan, and another team of responders can see the annotation.

Color codes discussed herein can take a number of forms. For example, a red, yellow green, and blue scheme can be used to indicate an urgent need, a low priority need, an OK status, and an out of position status, respectively. Other similar schemes, including highlighting, flashing, different size display icons, etc. can be used to quickly convey different levels of priority or urgency to a viewer can be utilized according to the disclosed system.

A teacher hitting the we're OK button during a fire alert or medical alert can automatically permit the system to monitor and display a location of the computerized device of the teacher for some time span, for example, through the duration of the drill. A corresponding message confirming the status of the teacher can be displayed on the principal's monitor along with a graphic illustrating a real-time location of the teacher.

A teacher hitting the danger nearby button during a fire alert or medical alert can automatically permit the system monitor and display a location of the computerized device of the teacher. In some instances, a cellular call can automatically be placed by the teacher's device to a coordinator such as the principal. In some instances, a second screen of buttons can be presented to the teacher to permit additional entry of information, for example, alerting the system to presence of a suspicious individual, a student being separated from the class, a locked door preventing the class from moving, or alerting the system to visible smoke or fire.

A teacher hitting the send help button during a fire alert or medical alert can automatically permit the system monitor and display a location of the computerized device of the teacher. In some instances, an immediate call from the phone of the teacher can be placed to emergency services (e.g. 9-1-1.) In some instances, a second screen of buttons can be presented to the teacher to permit additional entry of information, for example, requesting security assistance, requesting medical assistance, or prompting an immediate call to emergency services.

A teacher hitting the out of room button during a fire alert or medical alert can automatically permit the system monitor and display a location of the computerized device of the teacher. In some instances, location data for the class corresponding to that teacher can be flagged with a special color or a flashing designation to the system coordinator, for example, alerting the coordinator that that class is OK but will not be in the usual fire drill assembly area due to having been out of the classroom at the initiation of the drill. Other actions can be automatically prompted on the device of the teacher, for example, initiating an SMS text message to the system coordinator permitting the teacher to briefly state where the class is assembling in light of being out of position.

Similarly, an active shooter alert can cause buttons to be prompted on all of the teachers' devices. Automatic door locks can be activated by a system coordinator activating the active shooter alert. A silent alert can be activated on all of the teacher's exemplary cell phones, for example, vibrating the phone constantly until the teacher taps the screen of the phone. A graphic indicating a lock down of the school can be displayed. Buttons can be provided to the teacher permitting the teacher to immediately enter a status for the class. For example, four buttons can be presented to a teacher during a active shooter alert, the buttons prompting status updates from the teacher including 1) "We're OK," 2) "Danger Nearby," 3) "Send Help," and 4) "Out of Room."

A tactical response display can be operated during emergencies or drills. Such an tactical response screen can be the same or similar information that is provided to a system coordinator such as a principal. However, additional information can be provided, such as a tactical display of the school including interactive options for the responders. For example, responders get an exemplary color coded image of the floor plan for the school, and location data and status information for each of the classes can be provided. Graphics indicating last known locations of the shooter, active status reports for locked doors, and other information can be displayed. A responder can tap a particular teacher's icon and be connected by cellular communications with the teacher. One team of responders can annotate the floor plan, and another team of responders can see the annotation. Teams can coordinate actions through the tactical display, for example, one team coordinating a distraction such as a flash-bang device with timed movement of another team.

A teacher hitting the we're OK button during an active shooter alert can automatically permit the system to monitor and display a location of the computerized device of the teacher for some time span, for example, through the duration of the drill. A corresponding message confirming the status of the teacher can be displayed on the principal's monitor along with a graphic illustrating a real-time location of the teacher.

A teacher hitting the danger nearby button during an active shooter alert can automatically permit the system monitor and display a location of the computerized device of the teacher. In some instances, an SMS text window can be prompted on the teacher's device, for example, permitting the teacher to enter a message such as "strange noise in the hallway" or "two male students from class in restroom at time of lockdown." In some instances, a second screen of buttons can be presented to the teacher to permit additional entry of information, for example, alerting the system to presence of a suspicious individual, a student being separated from the class, or failure of a door to lock.

A teacher hitting the send help button during an active shooter alert can automatically permit the system monitor and display a location of the computerized device of the teacher. Immediate, urgent messages to responders can be initiated. An SMS text window can be prompted on the teacher's device, for example, permitting the teacher to enter a message. In some instances, a second screen of buttons can be presented to the teacher to permit additional entry of information, for example, requesting security assistance, requesting medical assistance, or prompting an immediate call to emergency services or responders.

A teacher hitting the out of room button during an active shooter alert can automatically permit the system monitor and display a location of the computerized device of the teacher. In some instances, location data for the class corresponding to that teacher can be flagged with a special color or a flashing designation to responders that that class is OK but will not be in the usual fire drill assembly area due to having been out of the classroom at the initiation of the alert. Other actions can be automatically prompted on the device of the teacher, for example, initiating an SMS text message to the responders, for example, permitting the teacher to provide a status of the class to the responders.

The disclosed system provides buttons on computerized devices for easy status entry for a teacher. In the provided examples, exemplary buttons are provided including "We're OK," "Danger Nearby," "Send Help," and "Out of Room." A number of different buttons or textual labels for the buttons are provided. One button should be provided to permit the teacher to state that the class is safe and under stable conditions. One button should be provided to provide the system coordinator or responders with an urgent, high priority message that the class needs help. In one embodiment, teachers can be presented with any input method to provide a binary status, either "we're OK" or "we're not OK—send help" coupled with location information. In another embodiment, teachers can be presented with an intermediate need button, e.g., "we need help from the principal or nurse but not from 9-1-1." In another embodiment, teachers can be presented with an ability to state that the class is out of its normal position but no assistance is currently required. Four buttons enable teachers to provide any of these status updates. More buttons can be presented for different variations of needs or informational updates, but testing shows that if too many options are provided to the teacher upon a single screen, the ability of the teacher to quickly and easily find and depress the right button decreases.

Location software on the phone can be activated at all times, with exemplary cell phones of the teachers providing location data to the system whenever the teacher is at the school. In another example, location software on the phone can be activated only when either the teacher prompts the system for assistance or when a particular alert mode is activated. In another example, under non-alert conditions, QR codes or similar visual displays can be displayed in rooms around the school, and teacher procedures in the school can be implemented where the teacher, upon entering or leaving a classroom, cafeteria, gym, etc., scans the display with a camera device installed on the computerized device, and a current location for the class is monitored by the system without utilizing the location data from the device.

The system coordinator's display can include status updates for all of the teachers and staff using devices enabled with the disclosed system. In one embodiment, a simple list of every enabled device can be provided upon the display along with a current status. For example, if ten teachers, a nurse, and a janitor have enabled devices, twelve entries can be displayed upon the coordinator's screen. If nine of the teachers, the nurse and the janitor all provide "We're OK" status updates on their devices, but one teacher provides a "Danger Nearby" status with a text message entry "we smell smoke," the coordinator's display can highlight the status of the alerting teacher and provide appropriate green indications for the remainder of the entries. If during a subsequent evacuation, a student falls and is unconscious, one of the teachers that had previously entered "We're OK" can change status to "Need Help."

In another embodiment, the coordinator's display can include a tactical display, for example, including a floor plan of the school and coordinated location data from each of the enabled devices. A small color coded icon can be displayed for each device, for example, with a designation of a last name of each device holder and a color coded status update. Other relevant information can be displayed on the screen, such as status of locked doors, a location of a fire alarm that has been activated, and a status reply from first responders, for example, stating "911: medical alert received—ambulance ETA 5 minutes." Other options can be presented upon the coordinator's display, for example, permitting the coordinator to easily call any of the school personnel or 9-1-1. In one embodiment, the coordinator can enter a textual message to be provided to all of the enabled devices and/or to responders. In one embodiment, the coordinator can selectively control door locks. In one embodiment, the coordinator can annotate the floor plan of the school, for example, providing responders with a door that they should enter or the location of a medical emergency within a particular room.

A coordinator's device can be a desktop computer when the alert is a drill or lock-down event. The system coordinator's device can display a dashboard display, providing a summary of details for various teachers across the school facility through a drill or event. This display dashboard or a version of the display dashboard can be provided to others in the school, such as a vice principal or a school nurse, and to others in the emergency response community.

Figure 1:
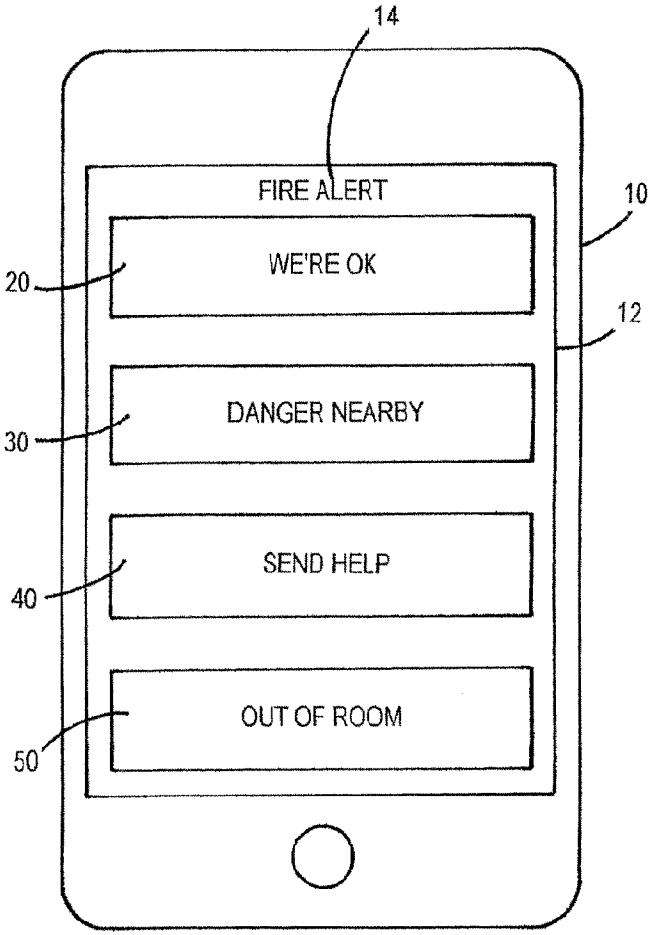
FIG. 1 illustrates an exemplary smart phone displaying buttons for a teacher to provide status information for a class during a fire alert, in accordance with the present disclosure.

Referring now to the drawings, wherein the showings are for the purpose of illustrating certain exemplary embodiments only and not for the purpose of limiting the same, FIG. 1 illustrates an exemplary smart phone displaying buttons for a teacher to provide status information for a class during a fire alert. A mobile computerized device embodied as smart phone 10 is illustrated. Smart phone 10 includes touch-screen display 12. Although smart phones are used to illustrate exemplary mobile computerized devices throughout the disclosure, other portable computerized devices including tablet computers, computerized eyeglasses or wrist watches, flip-phones, or any other similar devices could be utilized with the disclosed system, and the disclosure is not intended to be limited to the particular examples provided herein. Smart phone 10 is in communication with a remote server or other remote computerized system coordinating information for the principal, a system coordinator, or an emergency responders.

Display 12 includes banner 14 describing a current alert and four buttons 20, 30, 40, and 50 enabling the teacher or staff member using smart phone 10 to provide an instant update of the status of the teacher's class. Button 20 enables the teacher to provide the status that the class is OK. Button 30 enables the teacher to provide the status that danger or possible is perceived near the class. Button 40 enables the teacher to provide the status that urgent help is needed. Button 50 enables the teacher to provide the status that the class is not in its normal room. Smart phone 10 includes an internal location device enabling the phone to provide a current location for the phone when and after the status indication is made.

FIG. 2 illustrates an exemplary smart phone displaying buttons for a teacher to select requested help during a fire alert. Smart phone 10 is illustrated including display 12. Display 12 is illustrated showing a sub menu that can be provided to the teacher at any point during an alert. For example, after the teacher provides any status corresponding to buttons 30, 40, and 50 with any response other than the class is OK, the illustrated request assistance buttons 60, 70, and 80 can be provided to the teacher. Button 60 is an in-school security request, for example, requesting that the principal and other staff members come to the class' location. Button 70 is an in-school medical request, for example, requesting the school nurse to come to the class' location. Button 80 is an emergency response button, for example, immediately placing a call to a local 9-1-1 hotline (or a similar service where 9-1-1 is not available.)

Figure 3:
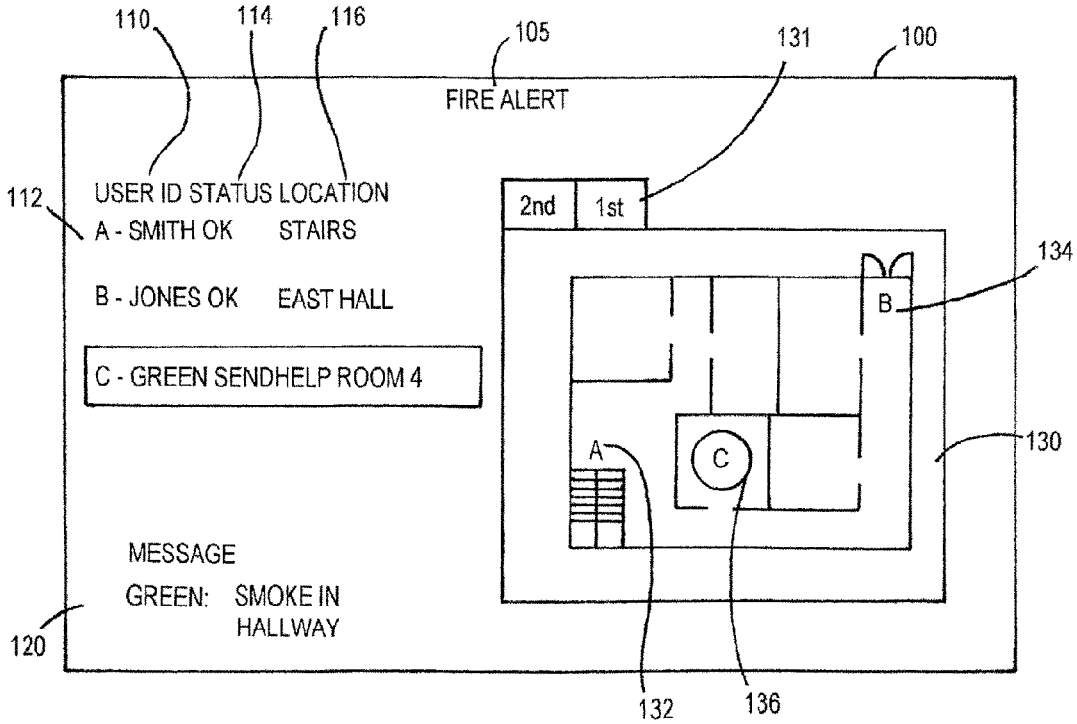
FIG. 3 illustrates an exemplary display utilized by a system coordinator for the school, displaying status indications by each of a plurality of teachers and in-school locations for each of the teachers during a fire alert, in accordance with the present disclosure.

FIG. 3 illustrates an exemplary display utilized by a system coordinator for the school, displaying status indications by each of a plurality of teachers and in-school locations for each of the teachers during a fire alert. Display screen 100 is illustrated including status information gathered from teachers around the school. Display 100 includes banner 105 indicating a present alert status. List display 110 provides a list of teacher user identifications 112, a status for each user identification 114, and a location for each user identification 116. In the illustrated example, two teachers have indicated OK status, while a third teacher has indicated that urgent help is required. Display 120 further includes a text message 120 provided by the alerting teacher. Display 100 further includes a tactical display 130 providing a floor plan for a floor of the school. Floor selection buttons 131 are provided permitting the system coordinator to toggle between floors. In one embodiment, the system will automatically display a one of many floors corresponding to a teacher providing an alert on that particular floor. Icons 132 and 134 indicate current locations of teachers with the OK status. Icon 136 indicates a current location for the alerting teacher.

Figure 4:
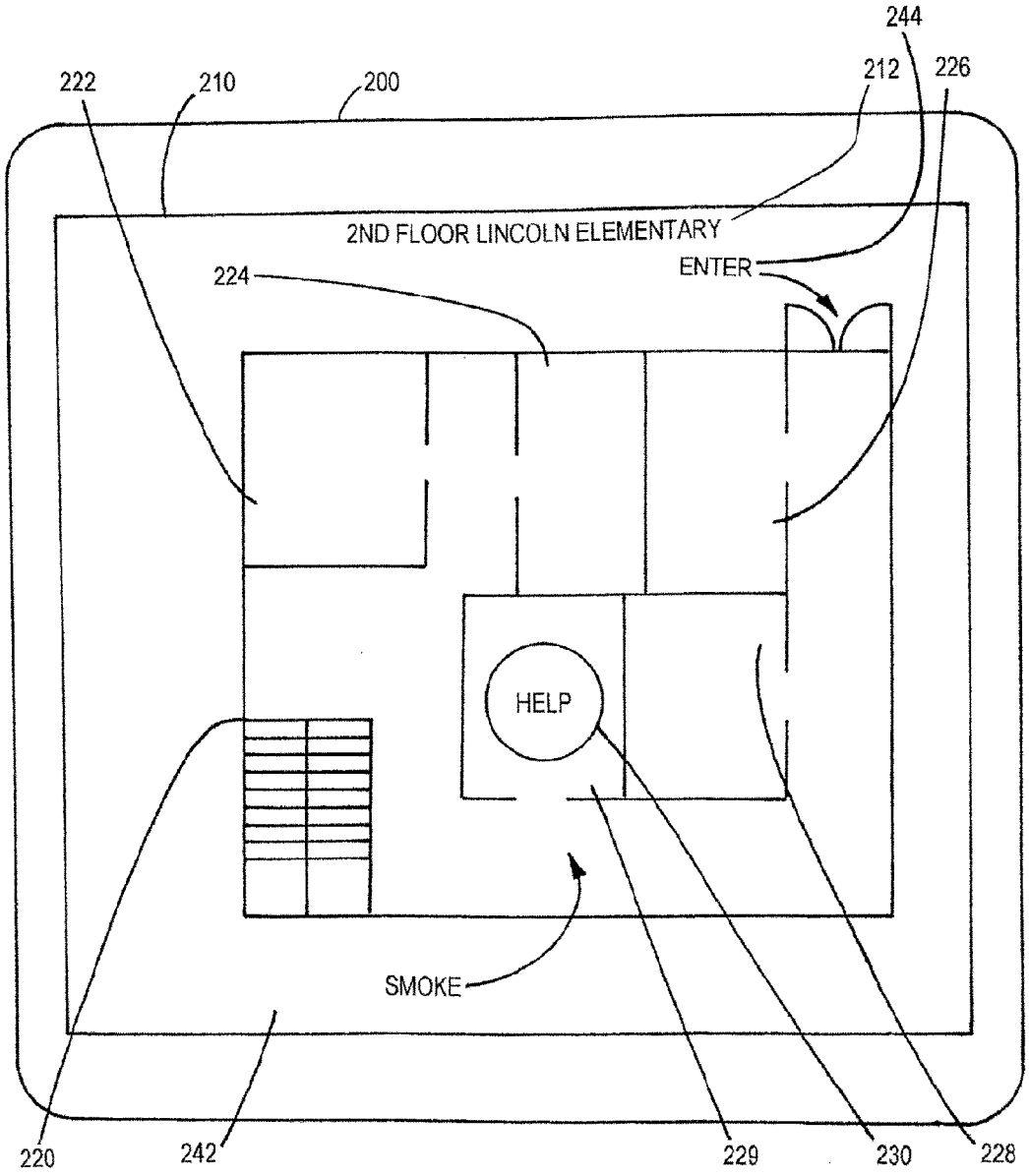
FIG. 4 illustrates an exemplary tactical display provided to emergency responders during a fire alert including status and location information provided by a teacher through a smart phone, in accordance with the present disclosure.

FIG. 4 illustrates an exemplary tactical display provided to emergency responders during a fire alert including status and location information provided by a teacher through a smart phone. Exemplary tablet computer 200 is illustrated including display 210 configured to assist an emergency responder arriving at the school. Banner 212 identifies the floor plan being displayed to ensure the responder can confirm that the correct floor plan is being displayed. Floor plan 220 is illustrated, including rooms 222, 224, 226, 228, and 229. Icon 230 is illustrated corresponding to a current location of an alerting teacher Annotations 242 and 244 are provided, for example, entered remotely by a system coordinator and/or a supervisor to the emergency responder.

Figure 5:
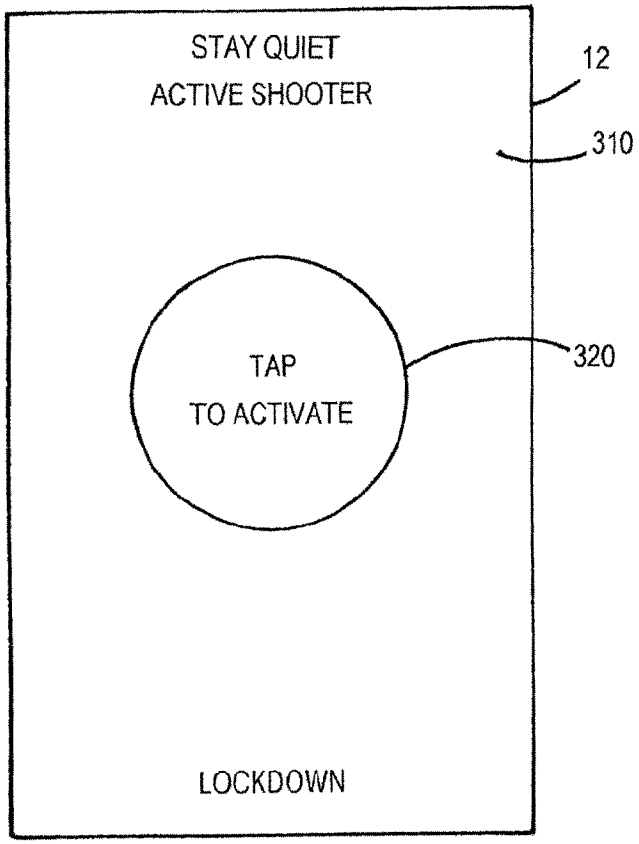
FIG. 5 illustrates an exemplary smart phone display while the phone silently alerting a teacher to an active shooter alert, in accordance with the present disclosure.

FIG. 5 illustrates an exemplary smart phone display while the phone silently alerting a teacher to an active shooter alert. Display 12 is illustrated including banner 310 conveying the shooter alert and prompt 320 requiring the teacher to acknowledge the alert. Such an alert can include an audible message. However, in some instances, it may be advisable for the phone to issue a silent or vibrating alert to avoid making noise to confirm a location for the active shooter to locate the teacher. Once the teacher acknowledges the alert, other prompts or buttons can be displayed for the teacher.

The acknowledgement message of FIG. 5 is optional. In one embodiment, the buttons of FIG. 6 can be immediately displayed during an active shooter alert.

Figure 6:
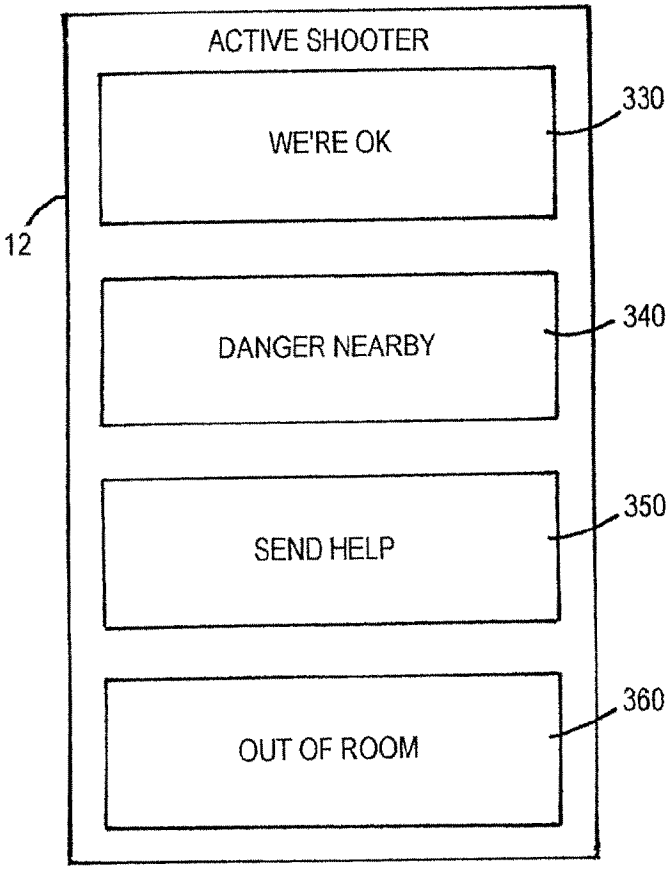
FIG. 6 illustrates an exemplary smart phone display displaying buttons for a teacher to provide status information for a class during an active shooter alert, in accordance with the present disclosure.

FIG. 6 illustrates an exemplary smart phone display displaying buttons for a teacher to provide status information for a class during an active shooter alert. Display 12 includes a banner describing a current alert and four buttons 330, 340, 350, and 360 enabling the teacher or staff member using a smart phone to provide an instant update of the status of the teacher's class. Button 330 enables the teacher to provide the status that the class is OK. Button 340 enables the teacher to provide the status that danger or possible is perceived near the class. Button 350 enables the teacher to provide the status that urgent help is needed. Button 360 enables the teacher to provide the status that the class is not in its normal room.

Figure 7:
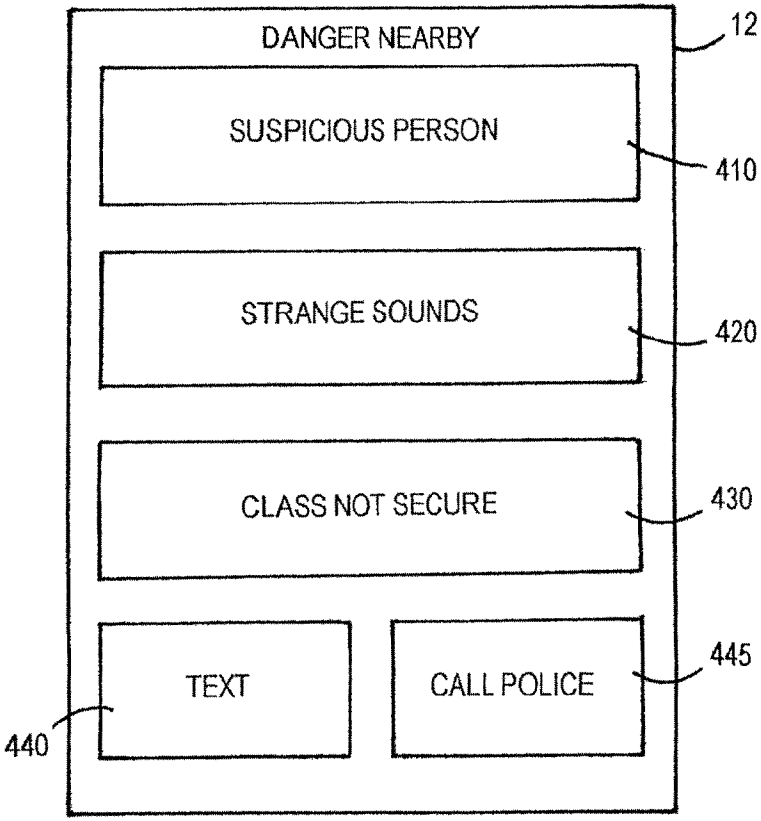
FIG. 7 illustrates the smart phone display of FIG. 6, include buttons of a sub-menu to a danger nearby selection, in accordance with the present disclosure.

FIG. 7 illustrates the smart phone display of FIG. 6, include buttons of a sub-menu to a danger nearby selection. Display 12 includes a banner describing a current alert and five buttons 410, 420, 430, 440, and 445 enabling the teacher or staff member using a smart phone to provide details regarding the perceived danger near the class. Button 410 identifies that a suspicious person has been seen near the class. Button 420 identifies that strange sounds have been heard near the class. Button 430 identifies that the teacher feels that the class is not in a secure location. Buttons 440 and 445 allow the teacher to either text or call the authorities, respectively.

Figure 8:
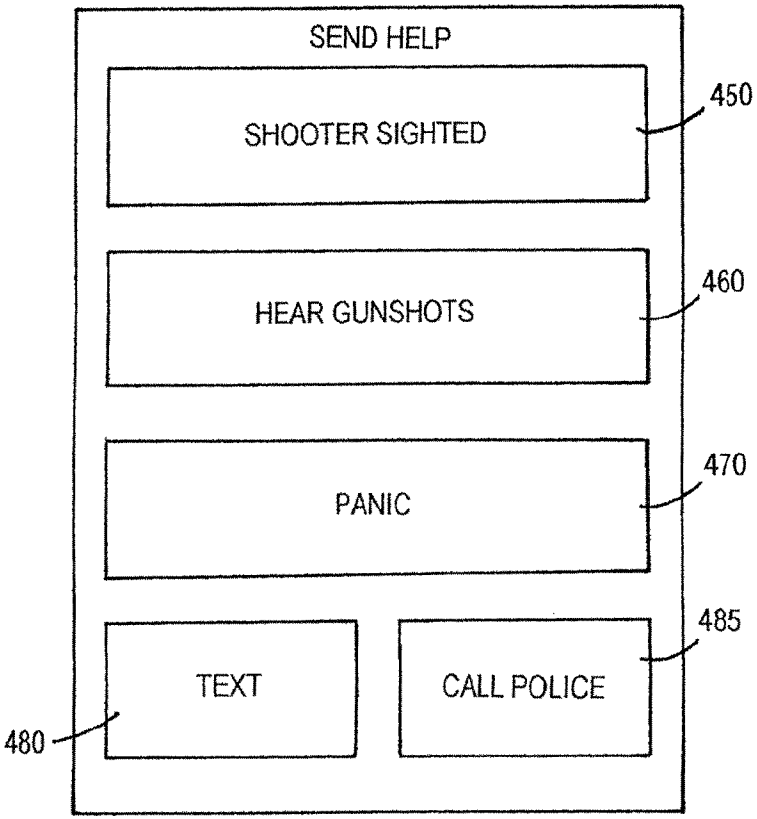
FIG. 8 illustrates the smart phone display of FIG. 6, include buttons of a sub-menu to a send help selection, in accordance with the present disclosure.

FIG. 8 illustrates the smart phone display of FIG. 6, include buttons of a sub-menu to a send help selection. Display 12 includes a banner describing a current alert and five buttons 450, 460, 470, 480, and 485 enabling the teacher or staff member using a smart phone to provide details regarding an urgent need for help. Button 450 identifies that a shooter has been seen near the class. Button 460 identifies that suspected gunshots have been heard near the class. Button 470 provides the teacher a panic button to indicate in an utmost urgent way that immediate help is required. Buttons 480 and 485 allow the teacher to either text or call the authorities, respectively.

Figure 9:
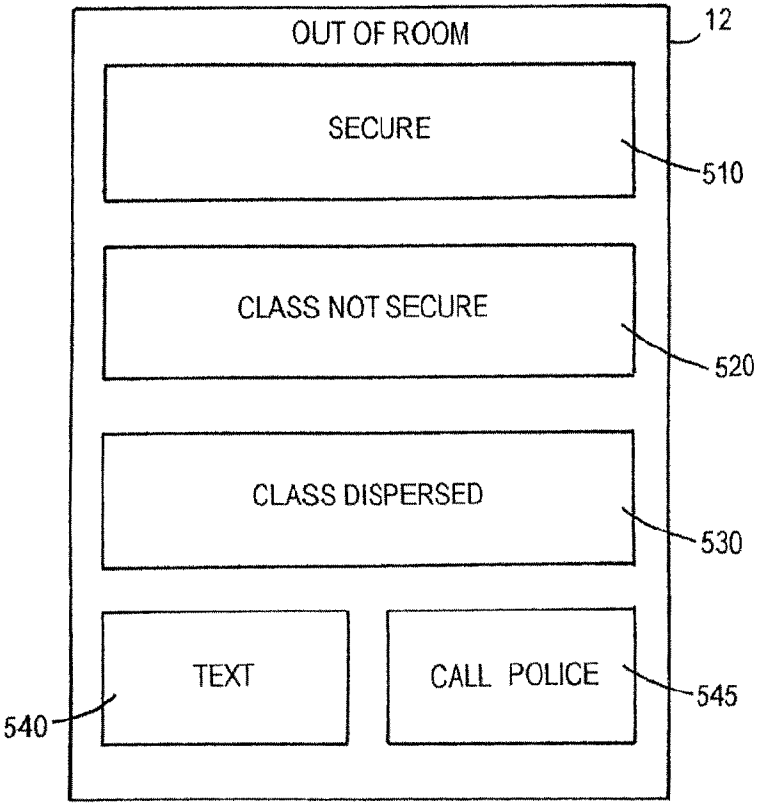
FIG. 9 illustrates the smart phone display of FIG. 6, include buttons of a sub-menu to a out of room selection, in accordance with the present disclosure.

FIG. 9 illustrates the smart phone display of FIG. 6, include buttons of a sub-menu to a out of room selection. Display 12 includes a banner describing a current alert and five buttons 510, 520, 530, 540, and 545 enabling the teacher or staff member using a smart phone to provide details regarding class being outside of its normal room. Button 510 identifies that while the class is outside of its normal class, the teacher believes that the class is secure, for example, in a locked library or gymnasium. Button 520 identifies the class is outside of its normal room and a secure location has not yet been found. Button 530 identifies that the teacher was unable to maintain order and that the class has dispersed outside of the control of the teacher. Buttons 540 and 545 allow the teacher to either text or call the authorities, respectively.

Figure 10:
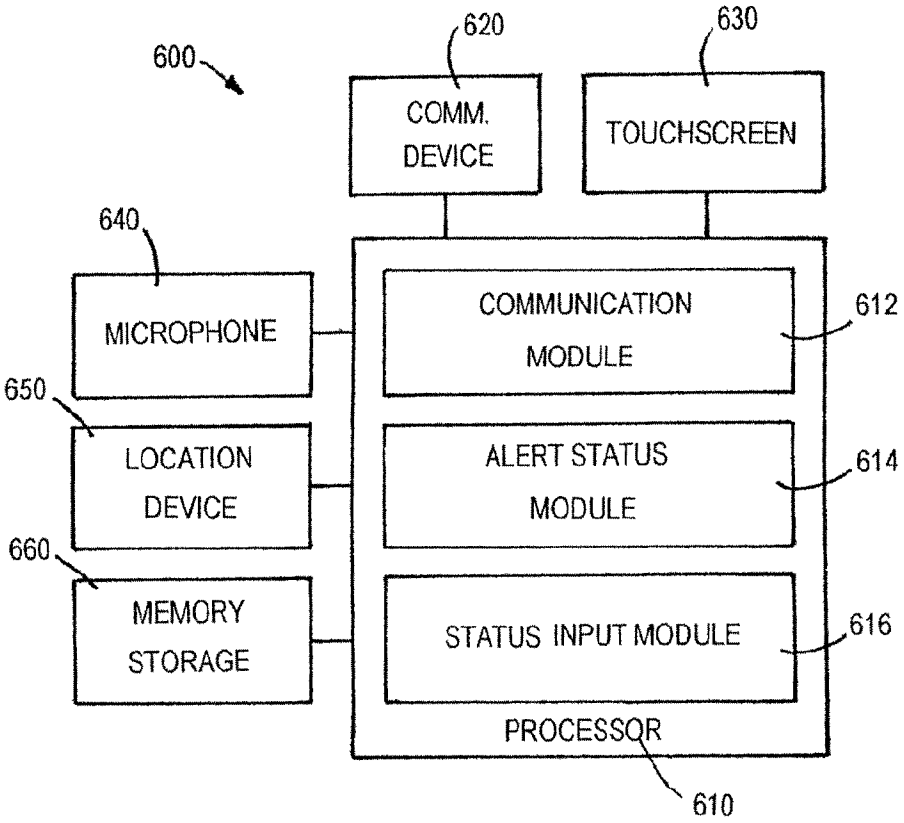
FIG. 10 schematically illustrates operation of an exemplary smart phone equipped with programming to operate the disclosed system and gather status information from teachers, in accordance with the present disclosure.

FIG. 10 schematically illustrates operation of an exemplary smart phone equipped with programming to operate the disclosed system and gather status information from teachers. Configuration 600 is exemplary of systems and devices within smart phone 10 and tablet computer 200. Configuration 600 includes a processor 610 configured to operate programmed code, RAM memory, and durable memory storage 660 embodied as a hard drive, flash memory, or other similar devices. Processor 610 operates programming modules which are configured to operate programming accomplishing various aspects of the disclosed system. The programming modules provided herein may exist on a single device or may span multiple devices and are provided as a non-limiting example of how processes described herein can be operated.

Processor 610 includes a communication module 612 which utilizes a connected communications device 620 to communicate wirelessly with a remote server or other devices over a communications network such as a cellular network. Processor 610 further includes an alert status module 614 configured to receive an alert status from a remote server and operate programming within processor 610 to implement steps or stages in a process based upon the alert status. Processor 610 further includes a status input module 616 including programming to provide the user with button inputs and other inputs on the connected touch-screen device 630 provided within configuration 600 and monitor user responses through those buttons.

Configuration 600 further includes a microphone device 640 and a location device 650. Configuration 600 is exemplary, and the disclosure is not intended to be limited to the particular examples provided herein related to computerized devices.

Figure 11:
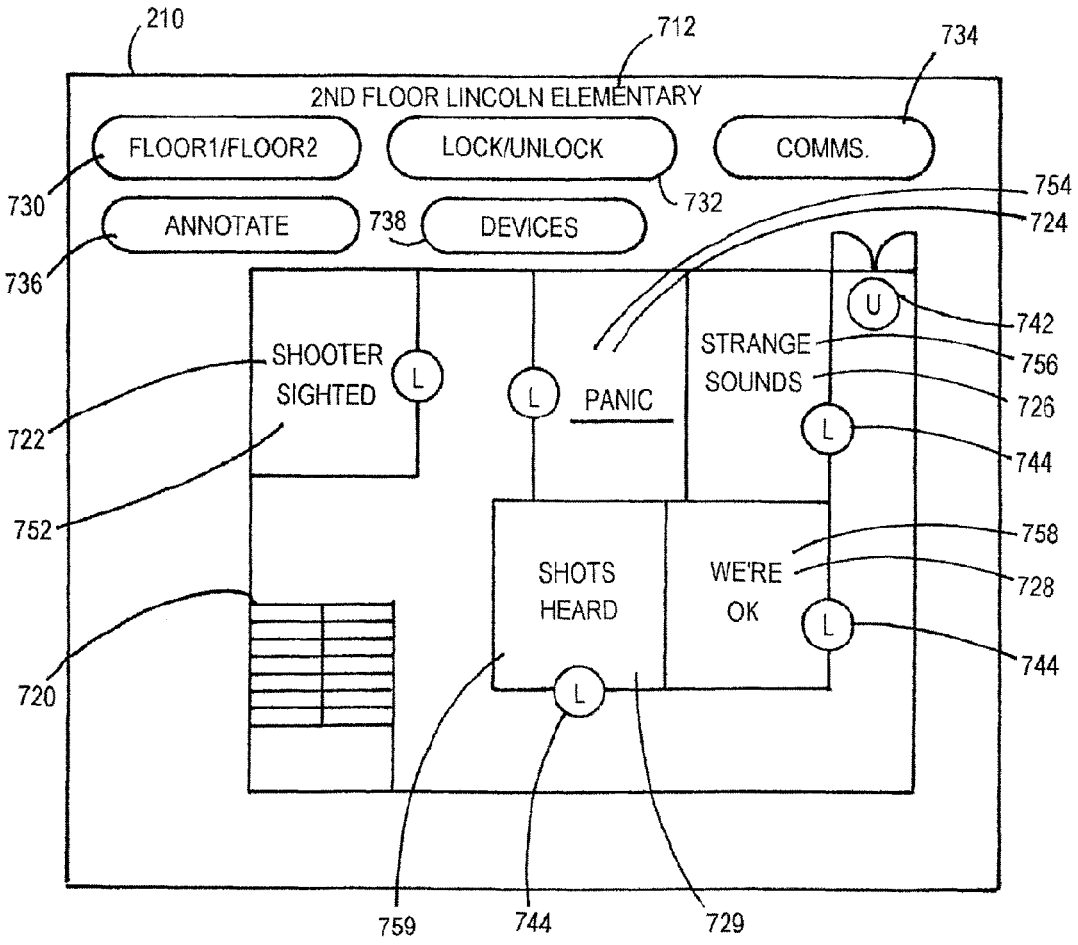
FIG. 11 illustrates an exemplary tactical display provided to emergency responders during an active shooter alert including status and location information provided by a teacher through a smart phone, in accordance with the present disclosure.

FIG. 11 illustrates an exemplary tactical display provided to emergency responders during an active shooter alert including status and location information provided by a teacher through a smart phone. Display 210 is illustrated including floor plan 720, banner 712 providing details of the displayed floor plan, and a plurality of buttons permitting the user to access various functions of the system. Floor plan 720 includes rooms 722, 724, 726, 728, and 729. Each room can have a corresponding status provided by a teacher in each of those rooms. Status 758 is provided for room 728 indicating that the teacher indicates that the class is OK. Status 756 is provided for room 726 indicating that the teach indicates that strange sounds have been heard. Status 759 is provided for room 729 indicating that gunshots have been heard. Status 752 is provided for room 722 indicating that a shooter has been sighted. Status 754 indicates that the teacher in room 724 has hit the panic button.

Status of locked and unlocked doors can be provided to the emergency responders through icons 744 and 742, respectively. In one embodiment, the emergency responder can control the locked/unlocked status through icons 744 and 742. In another embodiment, button 732 enables the user control locked and unlocked doors, for example, in a subsequent menu.

Button 730 enables the emergency responder to toggle floors of the school currently being displayed. Button 734 enables the emergency responder to access communications options, for example, listening to the microphones of teachers in any of the rooms. In one embodiment, camera inputs from the phones can additionally be accessed. Button 736 allows a team member to annotate the floor plan, for example, providing a current location for other team members to see. Button 738 provides a subsequent menu to access details about the various devices in the school.

Figure 12:
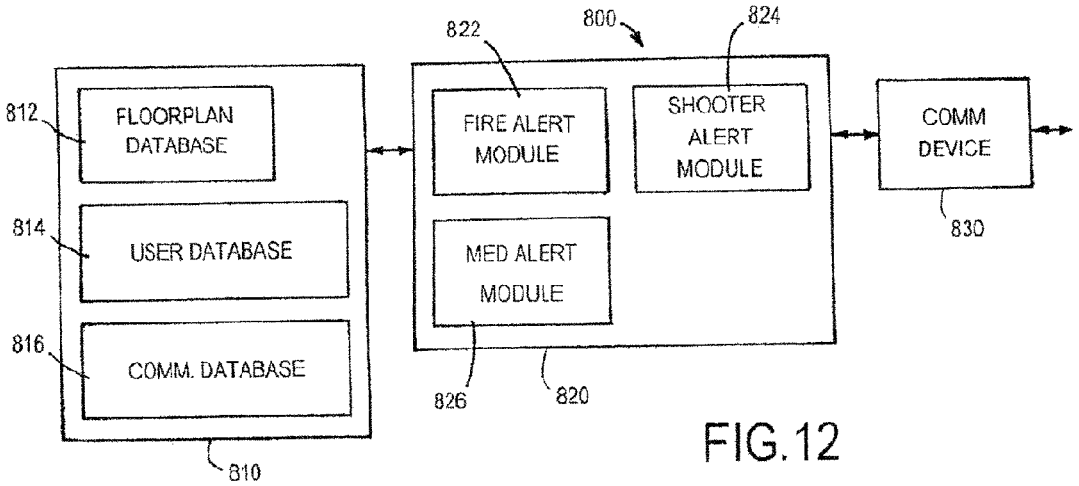
FIG. 12 schematically illustrates operation of an exemplary server operating the disclosed system to coordinate information gathered from teachers in a school and create real-time tactical information for emergency responders, in accordance with the present disclosure.

FIG. 12 schematically illustrates operation of an exemplary server operating the disclosed system to coordinate information gathered from teachers in a school and create real-time tactical information for emergency responders. Configuration 800 is illustrated including Memory storage 810, processing device 820, and communications device 830. Configuration 800 includes processing device 820 configured to operate programmed code, RAM memory, and memory storage 810 embodied as a hard drive, flash memory, or other similar devices. Processor 820 operates programming modules which are configured to operate programming accomplishing various aspects of the disclosed system. The programming modules provided herein may exist on a single device or may span multiple devices and are provided as a non-limiting example of how processes described herein can be operated.

Processor 820 provides and receives information to/from communication device 830, communicating wirelessly with other remote servers, computerized devices, and other systems over a communications network such as a cellular network. Processor 820 includes a fire alert module 822, a medical alert module 826, and a shooter alert module 824. Modules 822, 826, and 824 include programming configured to operate alert programming for each of a fire alert at a school, a medical alert at a school, and a shooter alert at a school, respectively. Modules 822, 826, and 824 are each configured to monitor inputs from teachers' devices, a system coordinator's devices, and emergency responders' devices. Modules 822, 826, and 824 are configured to initiate an alert status; cancel an alert status, prompt responses on user's devices; for example, commanding a device stop whatever it is doing and that buttons be presented upon the device's screen; manage flows of information; provide location data to a system coordinator and/or emergency responders; and other functions as disclosed herein.

Memory storage 810 includes floor plan database 812, user database 814, and communications database 816. Floor plan database 812 includes information related to floor plans and information necessary to convert floor plan images into tactical displays for emergency responders. User database 814 includes stored information about various devices enabled for use with the disclosed system. Communications database 816 includes stored information for use in communicating between various devices and remote systems as is required to operate the disclosed system.

Communications between the server and various devices of the disclosed system can be accomplished through a number of different communications connections or services known in the art. For example, a cellular connection can be utilized for two devices to communicate with each other. In other embodiments, telephone lines; broadband, digital subscriber line, or other internet connections; local area network or wireless local area networks; Bluetooth® connections; or other similar communications services can be utilized in accordance with the disclosed system.

Figure 13:
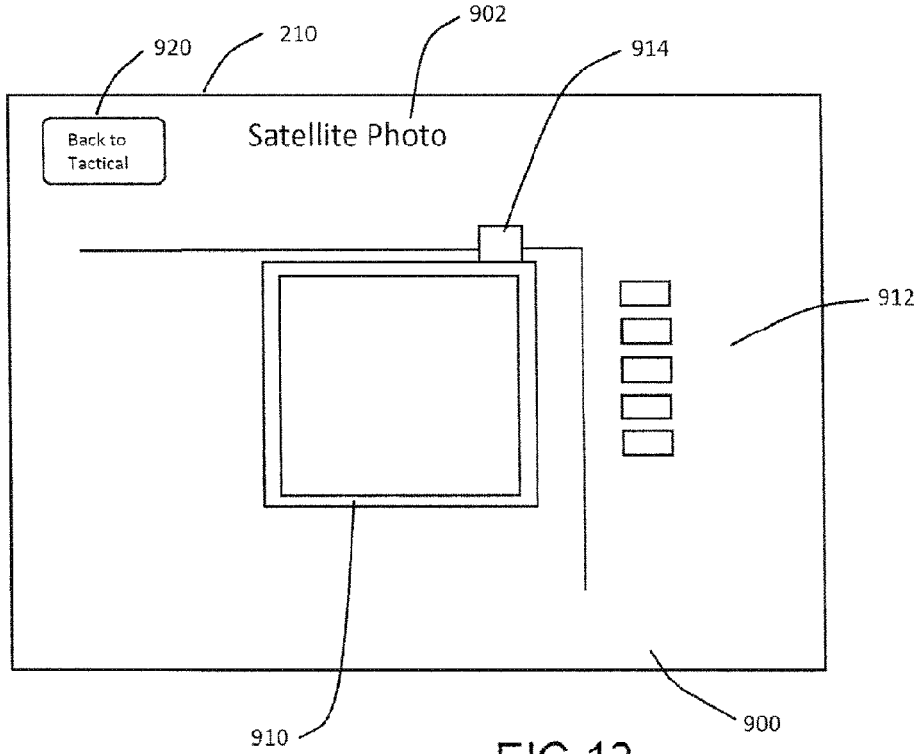
FIG. 13 illustrates an exemplary display including a satellite image of the school facility, in accordance with the present disclosure.

FIG. 13 illustrates an exemplary satellite view or image of the school facility. Such satellite images are widely available as stored historical images. Under special circumstances under the request of an emergency responder authority, a live feed from a satellite could be made available. Such a view quickly available to the responder team can provide contextual information to the responders. Wherein a satellite image is either a part of a larger overall image or a series of images are linked together geographically, the viewer could scroll or swipe a finger on the view to move the view around to areas surrounding the school or to zoom in or out the view. In other embodiments, such a satellite photo could be replaced with other photos that the responders could access, for example, if someone managed to snap an image of a shooter suspect. Display 210 is illustrated, including photo image 900. Exemplary photo image 900 includes banner 902, school image 910 including entrance 914, and parking lot 912. A button 920 is provided for quick access back to a tactical display. In the addition or alternative to satellite information, data including images or video can be provided from sources such as police helicopters or drones. In one embodiment, information can be provided from cameras mounted upon a policeman's uniform or helmet.

The disclosed system can be operated in a normal mode and a training mode. The training mode can be advantageous, as actual inputs from emergency responders participating in the training can enhance the realism of the training and reduce confusion when an actual event occurs. In one embodiment, teachers together in a training room can watch a projected view of the system coordinator's screen and the tactical display provided to responders as the teachers are prompted to provide inputs to their actual devices. A simulation can be run showing the teachers how the system will respond to their inputs, both to encourage the teachers to promptly enter information and also to improve confidence in the help that the system assists in providing.

Emergency responders can load programming onto a device in advance of an actual event. Upon activating the system, a responder can be prompted with the city in which the school being responded to exists and then with the school from a list of schools in that city. In another embodiment, the 9-1-1 operator can also have the programming installed, such that any information gathered by the operator can be stored with the tactical display in advance of the responder being dispatched. In another embodiment, wherein responders do not have the programming installed on a device, a remote server operating the disclosed programming can send via email, SMS text, or similar service an image of a tactical display to the responders including relevant information gathered by the system. In one embodiment, the system can iteratively send images to provide updated information to the responders.

Figure 14:
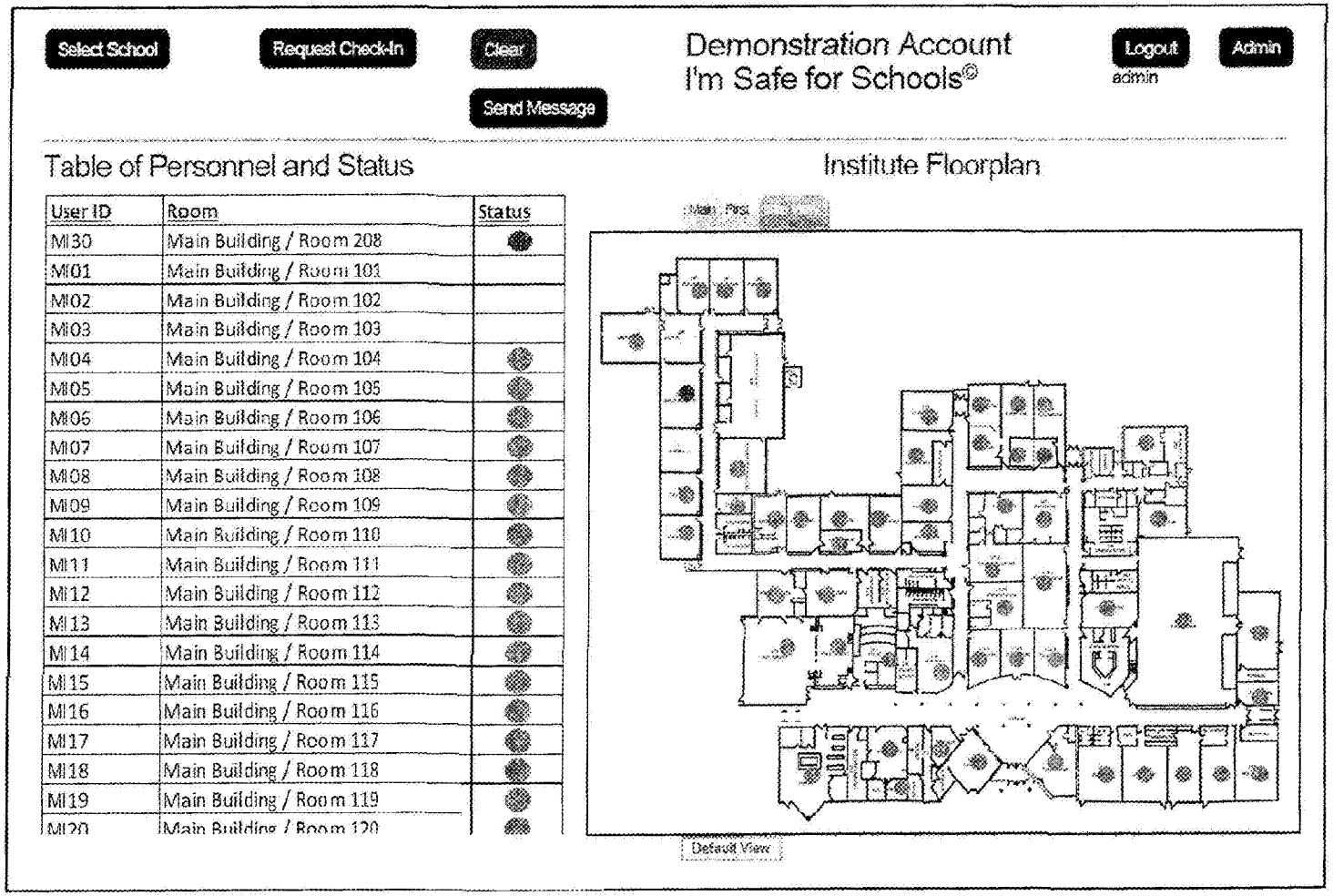
FIG. 14 illustrates an exemplary dashboard display wherein teachers have each reported a status in the rooms of the school, in accordance with the present disclosure.
Figure 15:
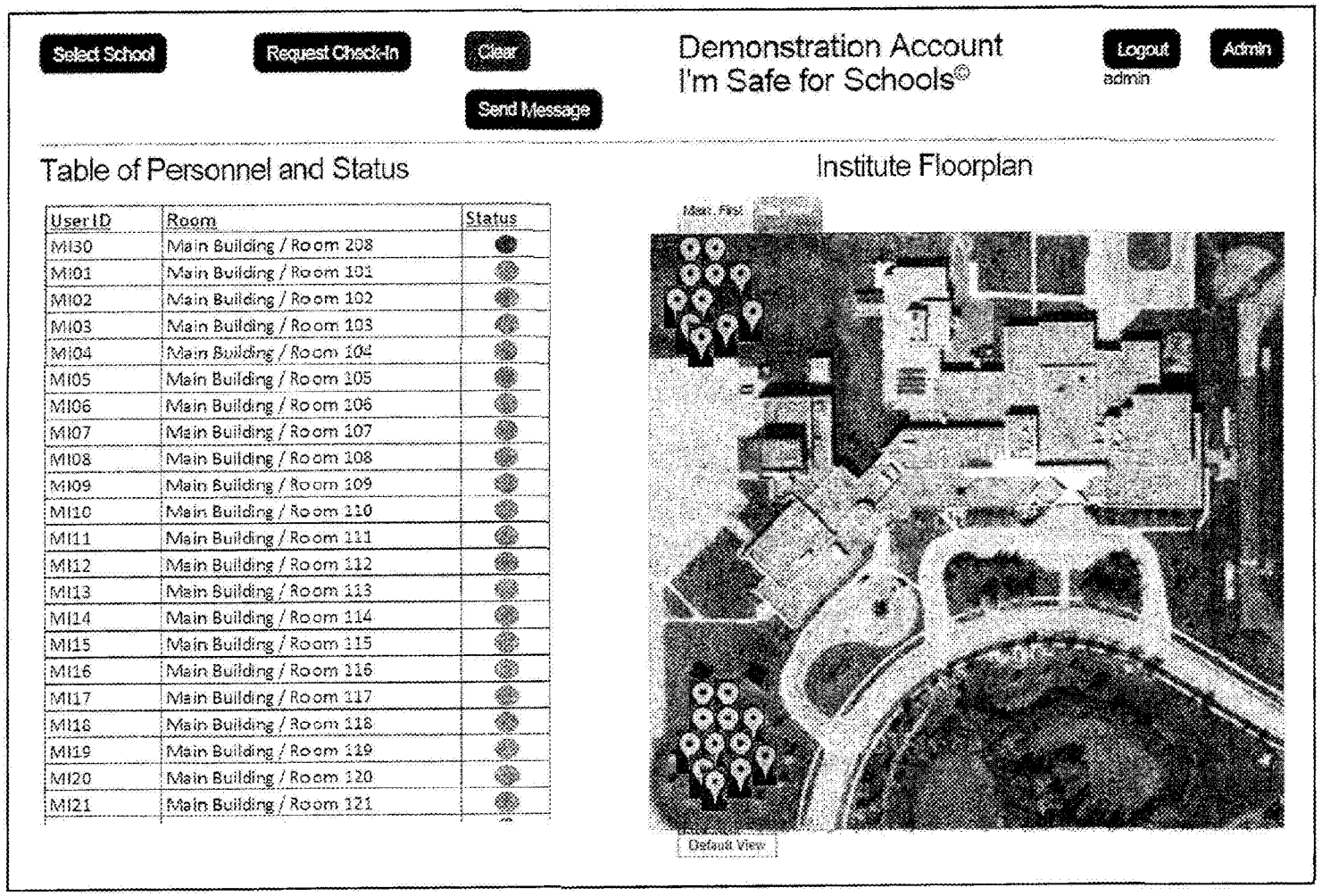
FIG. 15 illustrates an exemplary dashboard display wherein teachers have each reported a status during an evacuation of the school, in accordance with the present disclosure.
Figure 16:
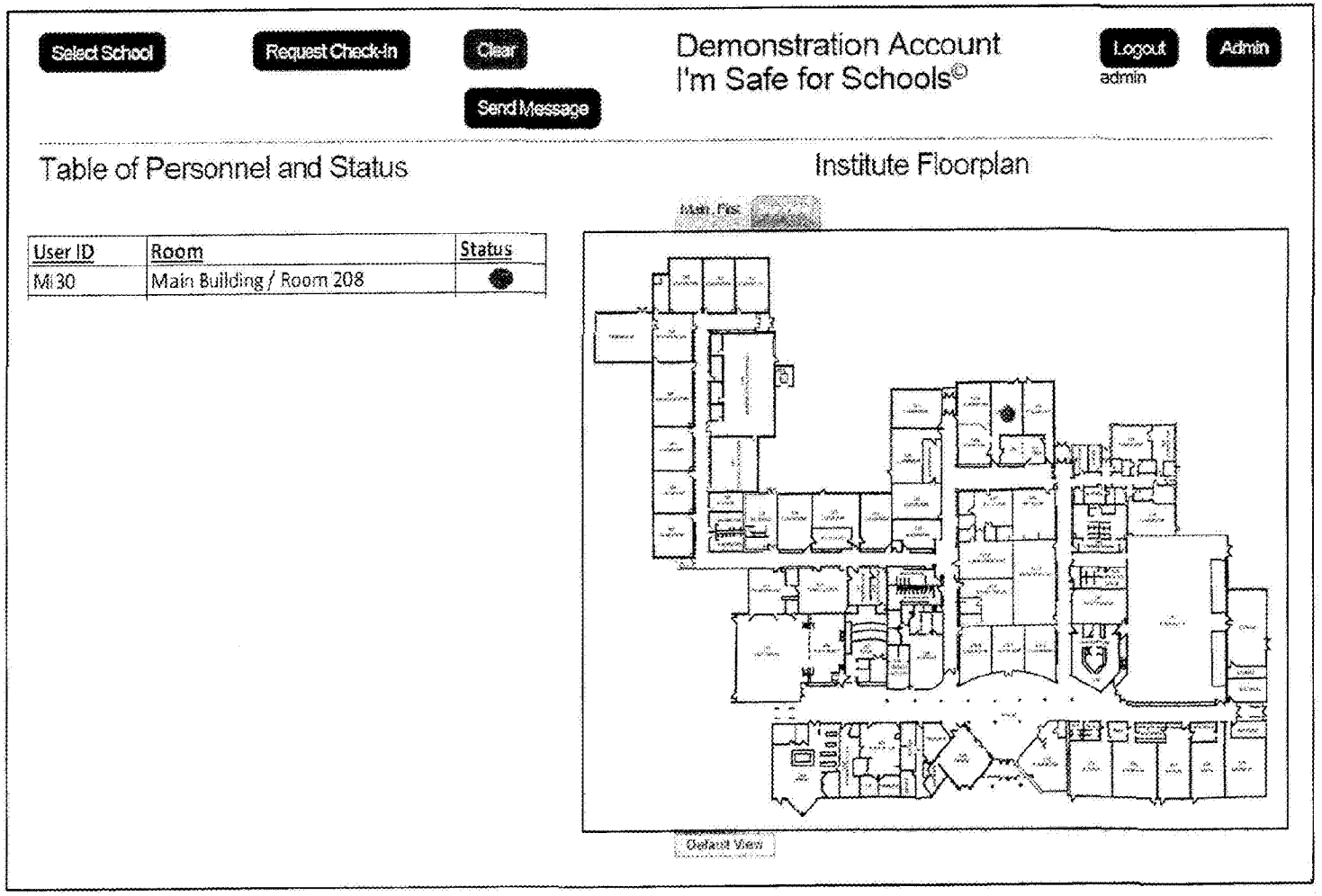
FIG. 16 illustrates an exemplary dashboard display wherein a single teacher has provided location information in association with a request for help, in accordance with the present disclosure.

The illustrations of FIGS. 14-16 are provided as non-limiting examples of how a dashboard display could appear. FIG. 14 illustrates an exemplary dashboard display wherein teachers have each reported a status in the rooms of the school. The illustrated display includes control buttons at a top of the display, an itemized list of status responses from the various teachers in the school, and a floor plan of the school including location and status information for each of the teachers.

FIG. 15 illustrates an exemplary dashboard display wherein teachers have each reported a status during an evacuation of the school. The illustrated display includes control buttons at a top of the display, and an itemized list of status responses from the various teachers in the school. An image of the school from above is illustrated including location and status information for the various classes during the evacuation.

FIG. 16 illustrates an exemplary dashboard display wherein a single teacher has provided location information in association with a request for help. The illustrated display includes control buttons at a top of the display, an itemized list of current status reports from the various teachers in the school, and a floor plan of the school including location and status information for each of the teachers currently requesting assistance.

The above description of illustrated examples of the present disclosure, including what is described in the Abstract, are not intended to be exhaustive or to be limited to the precise forms disclosed. While specific embodiments of, and examples for, the disclosure are described herein for illustrative purposes, various equivalent modifications are possible without departing from the broader spirit and scope of the present disclosure. Indeed, it is appreciated that the specific example values, times, etc., are provided for explanation purposes and that other values may also be employed in other embodiments and examples in accordance with the teachings of the present disclosure.

The invention claimed is:

1. A computerized school safety system providing information to an emergency responder about an alert at a school, comprising:

a computerized processor including programming configured to:

monitor inputs from a plurality of mobile computerized devices within the school, the inputs comprising:

location data for the mobile computerized devices;

an indication of a safe condition from at least one of the mobile computerized devices; and an indication of a not safe condition from at least one of the mobile computerized devices;

determine individual rooms on a floor plan for the school corresponding to each of the inputs;

combine the inputs with the floor plan for the school, the combining including designating the individual rooms on the floor plan as either safe or not safe based upon the inputs; and provide a tactical display to the emergency responder comprising indications to the individual rooms on the floor plan as safe and not safe.

2. The computerized school safety system of claim 1, wherein the indication of the not safe condition comprises a request for assistance from a teacher.

3. The computerized school safety system of claim 1, wherein the computerized processor further includes programming configured to:

monitor activation of a system alert; and present a status update request to the mobile computerized devices based upon the monitored activation; and wherein monitoring inputs from a mobile computerized device comprises monitoring a status update.

4. The computerized school safety system of claim 3, wherein the monitoring activation of the system alert comprises monitoring activation of a medical emergency alert.

5. The computerized school safety system of claim 3, wherein the monitoring activation of the system alert comprises monitoring activation of a fire drill emergency alert.

6. The computerized school safety system of claim 3, wherein the monitoring activation of the system alert comprises monitoring activation of an alert requesting in-school security assistance.

7. The computerized school safety system of claim 3, wherein the monitoring activation of the system alert comprises monitoring activation of an active shooter emergency alert.

8. The computerized school safety system of claim 3, wherein presenting the status update request comprises displaying a first button requesting help and a second button affirming that the person is not in danger.

9. The computerized school safety system of claim 3, wherein presenting the status update request comprises displaying a first button to a person requesting help, a second button affirming that the person is not in danger, a third button stating that danger is perceived nearby, and a fourth button stating that the person is not in a normal room.

10. The computerized school safety system of claim 3, wherein the computerized processor further includes programming configured to monitor text entry in combination with the status update.

11. The computerized school safety system of claim 1, wherein the computerized processor further includes programming configured to:

monitor a privacy setting activated upon the mobile computerized device; and wherein the monitoring inputs is based upon the privacy setting.

12. The computerized school safety system of claim 1, wherein the computerized processor further includes programming configured to:

request permission from the mobile computerized device to gather the inputs from the mobile computerized device; and wherein the monitoring inputs is based upon a response to the request.

13. The computerized school safety system of claim 1, wherein providing the tactical display further comprises providing the tactical display to a principal of the school.

14. The computerized school safety system of claim 1, wherein providing the tactical display further comprises providing the tactical display to an emergency telephone response service.

15. The computerized school safety system of claim 1, wherein providing the tactical display further comprises providing an image summarizing the tactical display to an emergency responder en route to the school.

16. The computerized school safety system of claim 1, wherein the computerized processor further includes programming configured to permit the emergency responder to selectively lock and unlock a door within the school.

17. The computerized school safety system of claim 1, wherein the computerized processor further includes programming configured to permit the emergency responder annotate the floor plan for display to another emergency responder.

18. The computerized school safety system of claim 1, wherein the computerized processor further includes programming configured to selectively display images transmitted from a remote camera device.

19. A computerized building safety system providing information to an emergency responder about an alert at a building, comprising:

a computerized processor including programming configured to:

monitor inputs from a plurality of mobile computerized devices within the building, the inputs comprising:

location data for the mobile computerized devices;

an indication of a safe condition from at least one of the mobile computerized devices; and an indication of a not safe condition from at least one of the mobile computerized devices;

determine individual rooms on a floor plan for the building corresponding to each of the inputs;

combine the inputs with the floor plan for the building, the combining including designating the individual rooms on the floor plan as either safe or not safe based upon the inputs; and provide a tactical display to the emergency responder comprising indications to the individual rooms on the floor plan as safe and not safe.

* * * * *